United States Patent [19]

Manos

[11] 4,394,016

[45] Jul. 19, 1983

[54] GAME USING THE HELICAL MOVEMENT OF A BALL OR VEHICLE

[76] Inventor: Pavlos Manos, Louka Ralli 8, Pireaus, Greece

[21] Appl. No.: 216,977

[22] Filed: Dec. 16, 1980

[30] Foreign Application Priority Data

Feb. 23, 1980 [GR] Greece ..... 61269

[51] Int. Cl.[3] ..... A63F 7/04

[52] U.S. Cl. ..... 273/109; 272/35; 46/43

[58] Field of Search ..... 273/112, 109; 46/43, 46/47, 175; 272/35, 46–48

[56] References Cited

U.S. PATENT DOCUMENTS

| | | | |
|---|---|---|---|
| 864,245 | 8/1907 | Hutchinson | 272/47 |
| 933,585 | 9/1909 | Ridgway | 272/46 |
| 1,186,966 | 6/1916 | Bramkamp | 272/35 |
| 2,752,725 | 7/1956 | Unsworth | 46/43 X |
| 3,423,872 | 1/1969 | Dodson | 46/43 |
| 3,610,624 | 10/1971 | Fleischer | 273/112 |

*Primary Examiner*—Richard C. Pinkham
*Assistant Examiner*—Scott L. Brown
*Attorney, Agent, or Firm*—Schwartz, Jeffery, Schwaab, Mack, Blumenthal & Koch

[57] ABSTRACT

A game having a first cylinder with an inner helical path and a second cylinder concentric with the first cylinder having a second helical path continuous with the first path. In one embodiment the paths are grooves in the cylinder walls. A ball having a smaller diameter than the groove is attempted to be rolled in the groove using centrifugal force. A hollow handle is attached at the bottom of the cylinder to catch the ball should it fall. In another embodiment the paths are tracks over which passenger vehicles move. The tracks are housed in enlarged cylinders driven by a parabolic lever.

1 Claim, 4 Drawing Figures

GAME USING THE HELICAL MOVEMENT OF A BALL OR VEHICLE

SUMMARY OF THE INVENTION

The invention relates to the construction of a game which may be realised in two forms.

One form applies to a large size game which can be used in a fair and the other is a small size game by means of which hand skill may be tested.

The small size form comprises a closed cylinder made of transparent material in the interior of which a second also transparent cylinder is placed. A groove in the shape of semi-circumference growing into a helicoid is marked in the internal walls of the cylinder.

The groove starts off from the bottom of the external cylinder and rises to its top, whence it continues on the top of the internal cylinder and reaches the bottom following a continuous helicoid path. In the middle of the bottom there exists an opening whence extends a closed transparent pipe, which is the point where the game is hold. A ball of diameter less than the diameter or the groove is placed in the pipe, so that the ball rolls easily inside the groove. The game consists in testing the skill of each player who must try using suitable circular movements and taking advantage of the centrifugal force exerted on the ball, to lift the ball through the groove of the external cylinder at its top and let the ball slide down the groove of the internal cylinder to reach the bottom of the latter. Then the player tries to transfer the ball from the bottom of the internal cylinder to the groove of the external cylinder and lift the ball to its top.

The hereby invented game can be played with rival players or it can be used for the entertainment and practicing of the one only player.

The prior art does not know of a similar game.

The large size game for fairs also consists of an external cylinder, which can merely comprise the helicoid lines or grooves that start at the bottom and rise to the top whereby they follow down the groove to the bottom of the internal cylinder. In this embodiment of the invention we have no handle but onto the continuous line or groove one or more vehicles move onto which passengers trowel. The whole system of cylinders (external and internal) moves wth a parabolic lever, so that the vehicles are sequentially given an impulse because of the centrifugal so that they move onto a helicoidal line or grooves rising and lowering alternately within the two cylinders.

BRIEF DESCRIPTION OF THE DRAWINGS

The invention can be embodied in many different ways. The attached drawings show an illustrative force of the invention.

Figure 1:
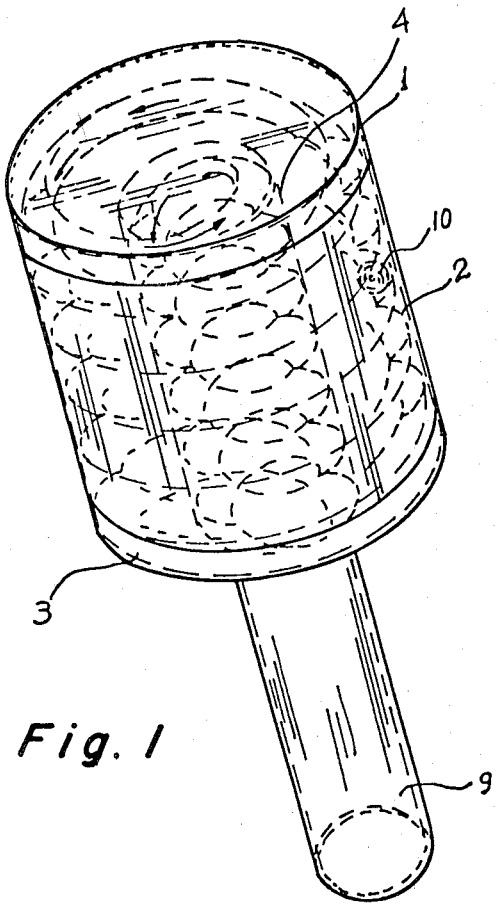
FIG. 1 shows a perspective view of the game with the ball shown in the external cylinder.
Figure 2:
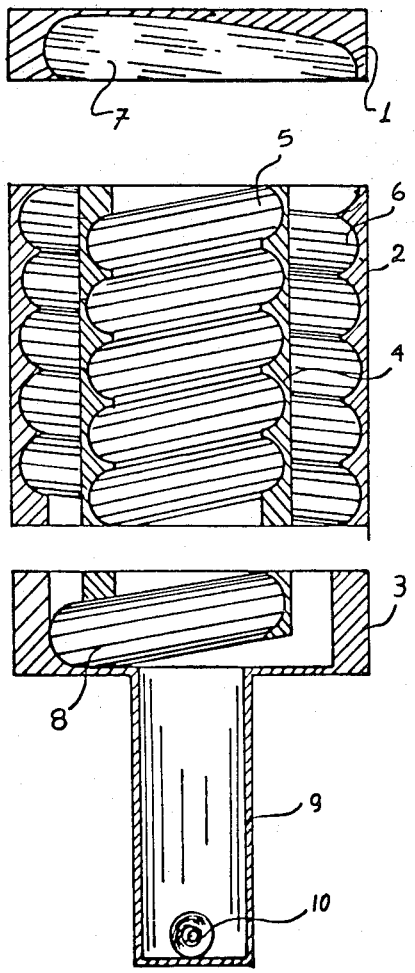
FIG. 2 shows a cross-sectional view along the cylinder where the bottom and top sections and the handle are also shown.
Figure 3:
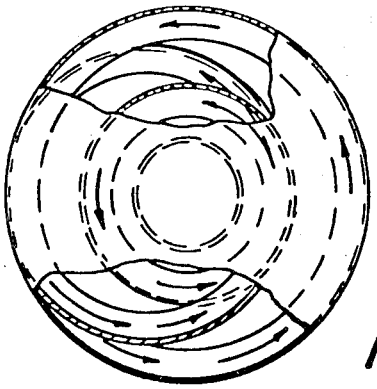
FIG. 3 shows a lateral cross-sectional view where the grooves of the internal and external cylinder are apparent rising from the bottom to the top.
Figure 4:
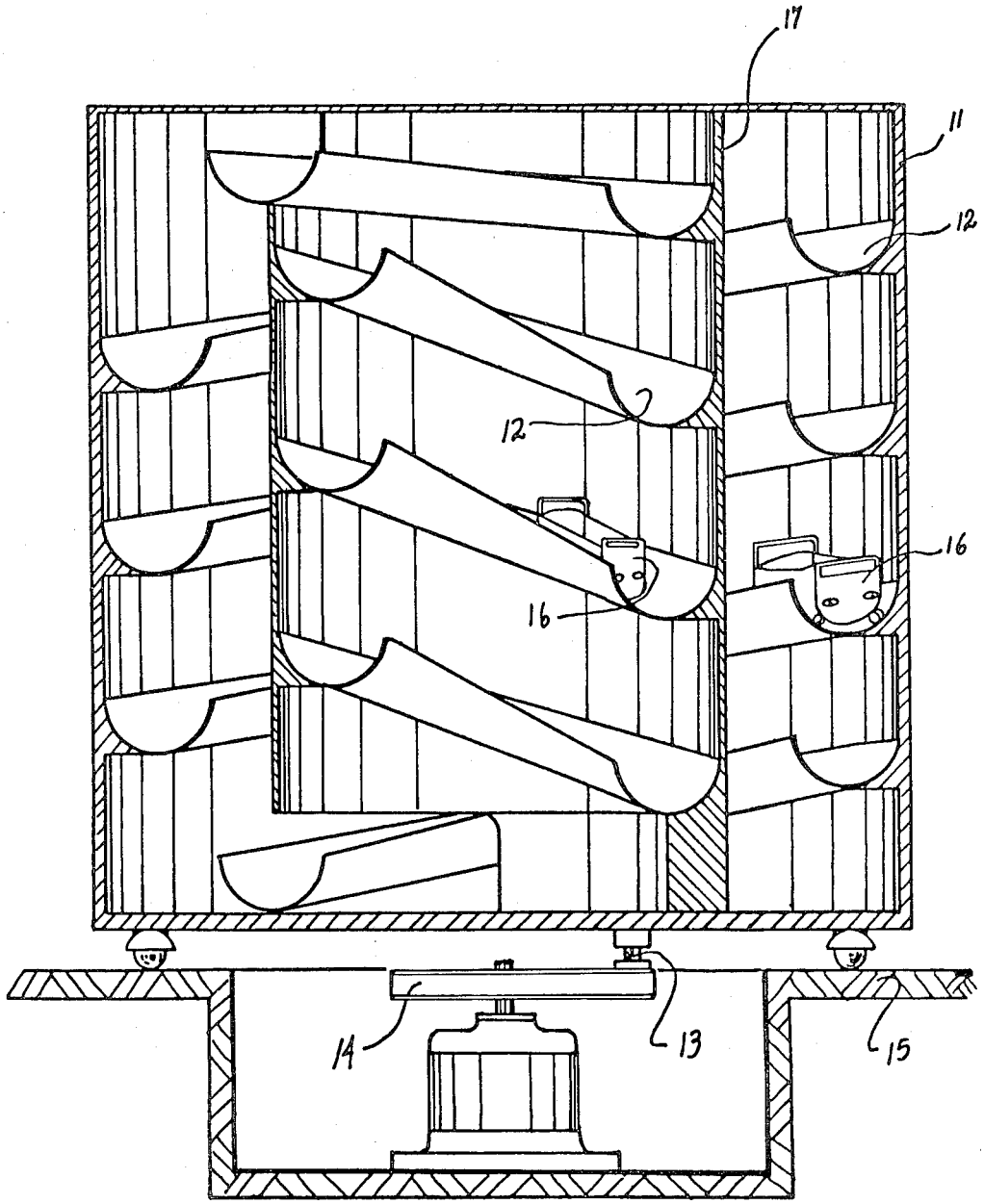
FIG. 4 shows a cross-sectional view of the large size game.

The main parts and components of the invention embodied in the hereby described illustrative example, numbered with numbers corresponding to those in the attached drawings, have as follows:

1. Top section joining the groove of the external cylinder 2 to the internal cylinder 4.

2. External cylinder having in its interior the helicoidal grooves 6.

3. Bottom section at the centre of which the handle 9 ends up and there also lies a groove that joins the helicoidal groove of the internal cylinder with that of the external.

4. Internal cylinder bearing internally the helicoidal grooves 5.

5. Helicoidal grooves of the internal cylinder which meet on the top groove 7 and on the bottom groove 8.

6. Helicoidal grooves of the external cylinder joining on their top the groove 7 and on their bottom 3 the groove 8.

7. Groove of the top member 1.

8. Groove of the bottom 3.

9. Handle mounted onto the bottom 3. It communicates internally with the groove 8. The ball 10 is dropped into the hollow handle.

10. Ball moved by the centrifugal force inside the groove.

11. Cylinder formed of lines or groove 12, inside which the vehicle 16 moves. The cylinder moves via a lever 13.

12. Groove or line onto which the vehicle 16 moves.

13. Lever placed at a parabolic point of the bottom of the cylinder 11, setting the latter in parabolic motion.

14. Gear mounted onto a shaft which bears the lever 13 onto one of its ends, whereby the gear is set in rotary motion.

15. Plane where the cylinder 11 and 17 are mounted.

16. Vehicle moving inside the groove or line.

17. Internal cylinder which can be still and the vehicle going down the groove through gravitational forces.

CONSTRUCTION AND OPERATION

The invention can be reached in any desirable form, size or shape. The drawings attached in the present specification do not comprise a limiting but merely an illustrative embodiment. Any modification to these drawings that does not comprise a new idea and does not assist the development of the invention, or does not assist the solution of any technical problem, does not limit the rights claimed for the present invention.

The small size game comprises in trying after grasping the cylinder by the handle, to move it in such a way so that with a few movements lift the ball to the top and then lower it down.

The large size game asks the passengers of the vehicles to try and move the vehicles quicker, so that they rise swiftly to the top. The passengers can also use brake levers to try and stop the backward movement of the vehicles, when the external cylinder moves sequentially with short bursts.

I claim:

1. An amusement device comprising:

a first cylinder having a helicoidal passageway formed therein;

a second cylinder having a helicoidal passageway formed therein and surrounded by said first cylinder;

wherein said helicoidal passageway from said first cylinder intersects with said helicoidal passageway of said second cylinder forming a continuous passageway in said first and second cylinders, said continuous passageway comprising channels in the walls of said first and second cylinders, a hollow handle mounted beneath said first and second cylinders, and a movable member arranged for free movement within said continuous passageway, and said hollow handle, wherein said movable member comprises a ball.

* * * * *